US005794596A

United States Patent [19]

Butler et al.

[11] Patent Number: 5,794,596

[45] Date of Patent: Aug. 18, 1998

[54] METHOD AND SYSTEM FOR PREDICTABLY CONTROLLING AIR/FUEL RATIO

[75] Inventors: James William Butler, Livonia; Alex David Colvin, Oak Park; Thomas John Korniski, Livonia, all of Mich.

[73] Assignee: Ford Global Technologies, Inc., Dearborn, Mich.

[21] Appl. No.: 837,169

[22] Filed: Apr. 14, 1997

[51] Int. Cl.[6] ..... F02M 51/00

[52] U.S. Cl. ..... 123/488

[58] Field of Search ..... 123/488, 494, 123/350, 571; 364/431.05

[56] References Cited

U.S. PATENT DOCUMENTS

| | | | |
|---|---|---|---|
| 4,548,185 | 10/1985 | Pozniak | 123/571 |
| 4,630,206 | 12/1986 | Amano et al. | 364/431.07 |
| 4,721,087 | 1/1988 | Kanno et al. | 123/488 |
| 5,159,914 | 11/1992 | Follmer et al. | 123/494 |
| 5,367,462 | 11/1994 | Klenk et al. | 364/431.05 |
| 5,394,331 | 2/1995 | Dudek et al. | 364/431.05 |
| 5,469,826 | 11/1995 | Thomas et al. | 123/488 |
| 5,615,654 | 4/1997 | Weisman, II et al. | 123/350 |

*Primary Examiner*—Raymond A. Nelli
*Attorney, Agent, or Firm*—Allan J. Lippa; Roger L. May

[57] ABSTRACT

A method and apparatus for controlling air/fuel ratio of an internal combustion engine at a desired level of richness or leanness utilizes an existing air flow sensor for sensing air flow into the engine and generating a corresponding air flow signal. A signal multiplier multiplies the air flow signal by a constant to generate a modified air flow signal corresponding to the desired level of richness or leanness. A control signal is then generated for controlling the air/fuel ratio to the desired level.

20 Claims, 5 Drawing Sheets

METHOD AND SYSTEM FOR PREDICTABLY CONTROLLING AIR/FUEL RATIO

TECHNICAL FIELD

This invention relates to methods and systems for predictably controlling air/fuel ratio of an internal combustion engine during open loop engine operation without the use of feedback sensors.

BACKGROUND ART

There may be times at which it is desirable to run an internal combustion engine either rich or lean, rather than at stoichiometry. For example, regulatory agencies are contemplating the use of roadside sensors to measure exhaust levels emitted from an automotive vehicle in an effort to identify vehicles that do not meet emissions standards. In order to monitor the response of the roadside sensors in their environment, i.e., outdoors at various temperatures and conditions, it is desirable to run an internal combustion engine at a known rich or lean operation to verify the performance of the roadside sensors.

Since an internal combustion engine of an automotive vehicle is typically programmed to run at or near stoichiometry, it is difficult to run the engine either rich or lean without modifying the program stored within the Electronic Control Unit (ECU) accordingly. Thus, there exists a need for a device that allows an engine to be run rich or lean for testing and developmental purposes without having to modify the engine strategy, such as catalyst efficiency measurements.

In addition, some geographical areas use leaded fuel which negatively affects both catalysts and oxygen sensors. In this situation, there exists a need for engine control without the possibility of oxygen feedback sensors. Thus, a predictable engine air/fuel ratio control is required.

Disclosure Of The Invention

It is thus a general object of the present invention to provide a method and system for predictably controlling air/fuel ratio of an internal combustion engine without the use of feedback sensors.

In carrying out the above object and other objects, features, and advantages of the present invention, a method is provided for controlling air/fuel ratio of an internal combustion engine to a desired level of richness or leanness wherein the engine has control logic connected thereto for normally controlling the air/fuel ratio at stoichiometry. The method includes sensing air flow into the engine and generating a corresponding air flow signal. The method also includes multiplying the air flow signal by a constant corresponding to the desired level of richness or leanness to generate a modified air flow signal. The method further includes determining a desired amount of fuel based on the air flow signal and the modified air flow signal, and controlling the fuel delivered to the engine based on the desired amount of fuel to obtain the desired level of richness or leanness.

In further carrying out the above object and other objects, features, and advantages of the present invention, a system is also provided for carrying out the steps of the above described method. The system includes an air flow sensor for sensing air flow into the engine and generating a corresponding air flow signal. The system further includes a signal multiplier for multiplying the air flow signal by a constant corresponding to the desired level of richness or leanness to generate a modified air flow signal. The control logic is further operative to determine a desired amount of fuel based on the air flow signal and the modified air flow signal and control the fuel delivered to the engine based on the desired amount of fuel to obtain the desired level of richness or leanness.

The above object and other objects, features and advantages of the present invention are readily apparent from the following detailed description of the best mode for carrying out the invention when taken in connection with the accompanying drawings.

BEST MODES FOR CARRYING OUT THE INVENTION

Figure 1:
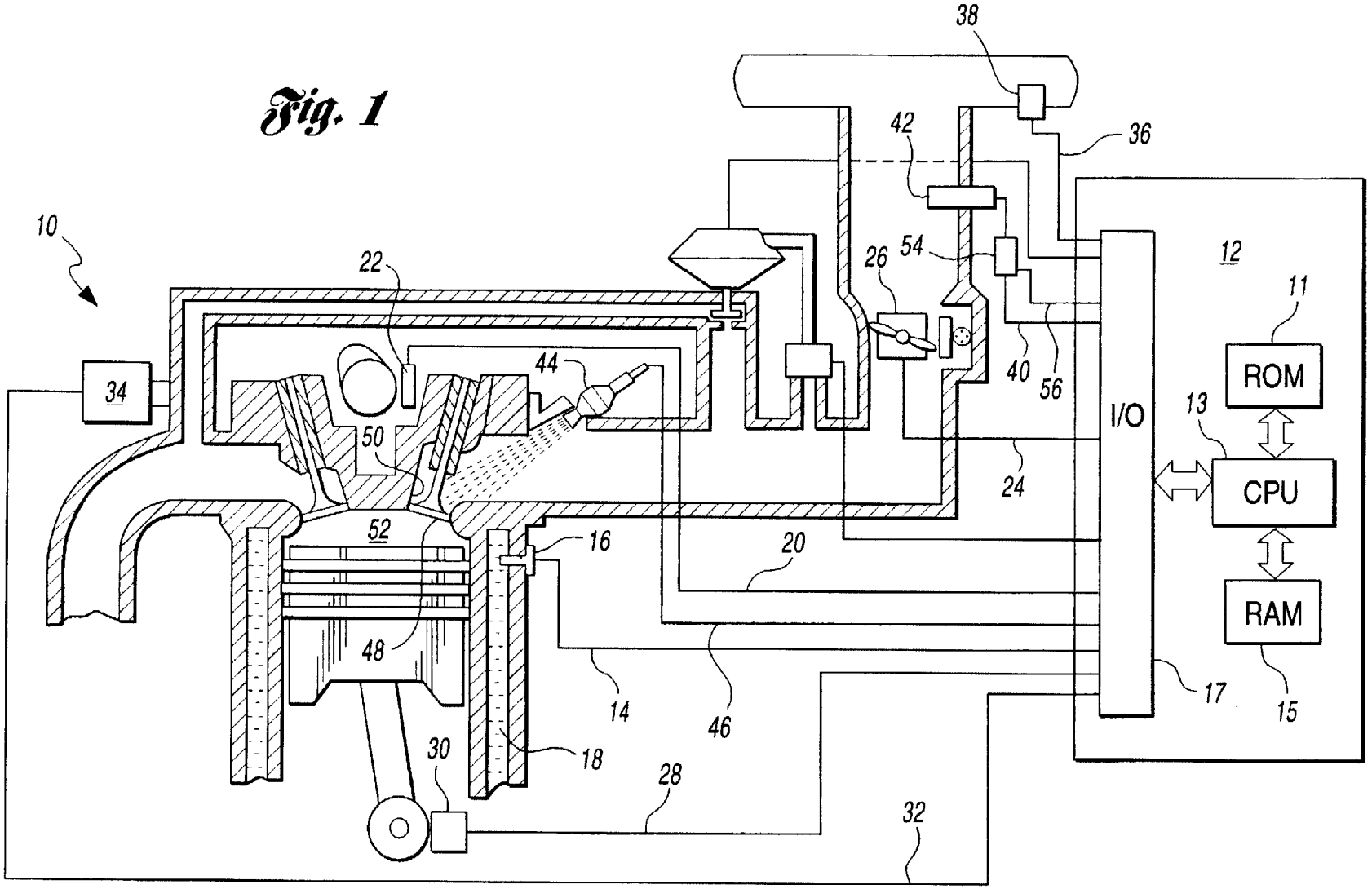
FIG. 1 is a schematic diagram of an internal combustion engine and an electronic engine controller which embody the principles of the present invention.

Turning now to FIG. 1, there is shown an internal combustion engine which incorporates the teachings of the present invention. The internal combustion engine 10 comprises a plurality of combustion chambers, or cylinders, one of which is shown in FIG. 1. The engine 10 is controlled by an Electronic Control Unit (ECU) 12 having a Read Only Memory (ROM) 11, a Central Processing Unit (CPU) 13, and a Random Access Memory (RAM) 15. The ECU 12 receives a plurality of signals from the engine 10 via an Input/Output (I/O) port 17, including, but not limited to, an Engine Coolant Temperature (ECT) signal 14 from an engine coolant temperature sensor 16 which is exposed to engine coolant circulating through coolant sleeve 18, a Cylinder Identification (CID) signal 20 from a CID sensor 22, a throttle position signal 24 generated by a throttle position sensor 26, a Profile Ignition Pickup (PIP) signal 28 generated by a PIP sensor 30, a Heated Exhaust Gas Oxygen (HEGO) signal 32 from a HEGO sensor 34, an air intake temperature signal 36 from an air temperature sensor 38, and an air flow signal 40 from an air flow sensor 42. The ECU 12 processes these signals received from the engine and generates a fuel injector pulse waveform transmitted to the fuel injector 44 on signal line 46 to control the amount of fuel delivered by the fuel injector 44. Intake valve 48 operates to open and close intake port 50 to control the entry of an air/fuel mixture into combustion chamber 52.

The apparatus of the present invention, shown at reference numeral 54, is positioned in line between air flow sensor 42 and ECU 12. For developmental or testing purposes, the apparatus 54 may be removably connected to air flow sensor 42 and ECU 12. Alternatively, apparatus 54 may be fixably secured between air flow sensor 42 and ECU 12, in which case it would be disabled during closed-loop engine operation via control signal 56 from ECU 12.

Figure 2:
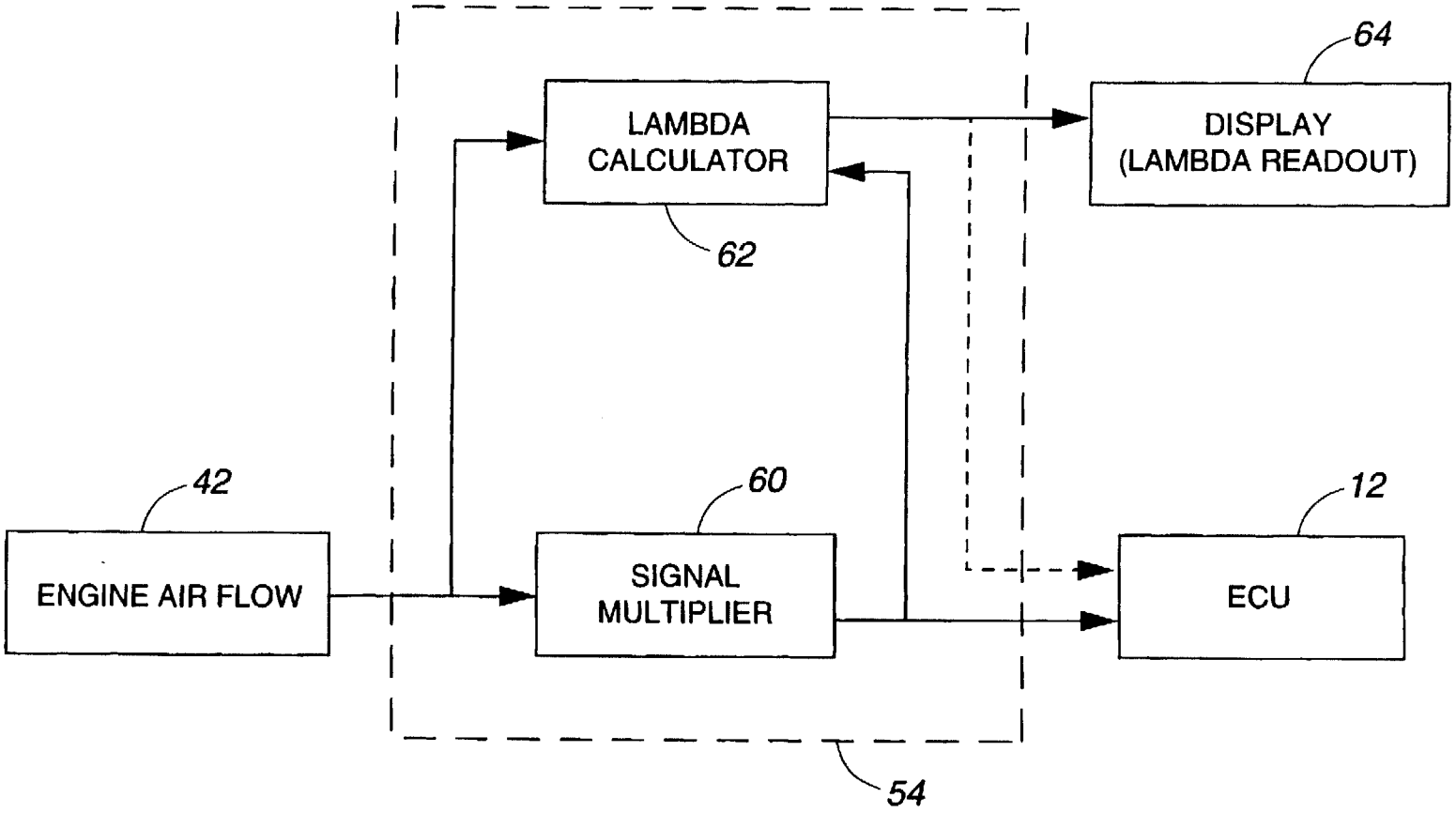
FIG. 2 is a simplified block diagram of the apparatus of the present invention.

A simplified block diagram of apparatus 54 is shown in FIG. 2. Apparatus 54 includes a signal multiplier 60 and a lambda calculator 62. The analog signal from the air flow sensor 42 is multiplied by signal multiplier 60, and the resultant signal is transferred to ECU 12 instead of the original air flow signal. The modified air flow signal, in conjunction with the original air flow signal, corresponds to a desired level of richness or leanness. With all the exhaust gas oxygen sensors 34 disabled or disconnected, ECU 12 determines the fuel delivered based on the modified air flow signal, thereby running the engine predictably rich or lean.

Figure 3:
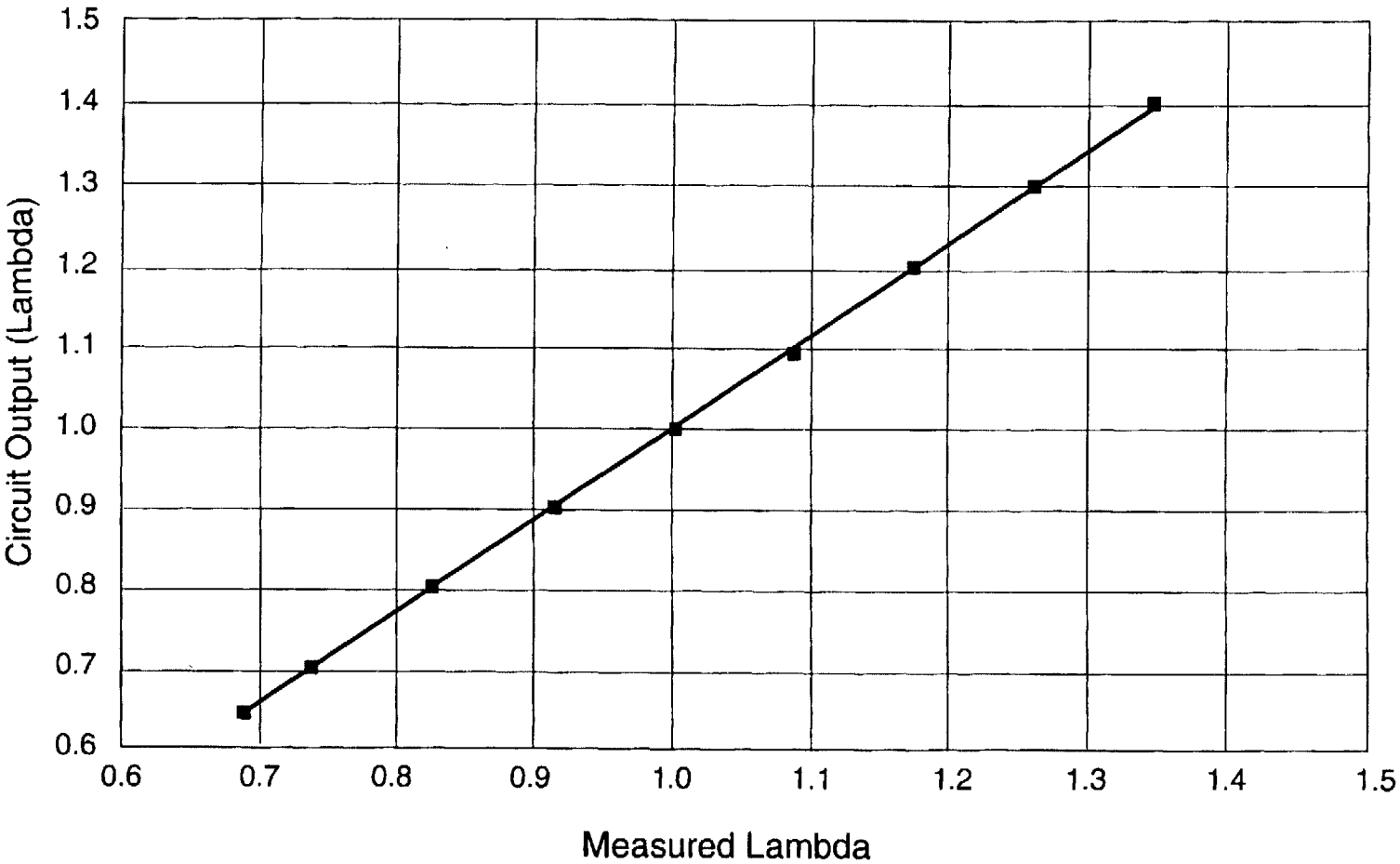
FIG. 3 is a graph illustrating the relationship between the actual measured lambda and the lambda obtained from the apparatus of the present invention.

The analog signal from air flow sensor 42, as well as the modified air flow signal, is preferably transferred to lambda calculator 62 so that the new lambda corresponding to the desired level of richness or leanness can be calculated. The output of the air flow sensor 42 is approximately proportional to the square of the actual air flow. Lambda, which is defined as:

$$[\text{Air/Fuel}]/[\text{Air/Fuel}]_{at\ stoichiometry}$$

can be estimated by calculating the square of (the input flow signal divided by the output flow signal), wherein the output flow signal corresponds to the modified input flow signal. The output of lambda calculator 62 can then be displayed on a display 64. For developmental or testing purposes, display 64 may be an integral component of apparatus 54. For production purposes, on the other hand, the output of lambda calculator 62 may be sent to ECU 12 for other engine control functions, as shown in FIG. 2. FIG. 3 is a graph illustrating the relationship between lambda as actually measured by external sensors and the lambda as calculated by apparatus 54. The relationship is essentially linear, indicating that apparatus 54 of the present invention can be used to calculate lambda without the use of external sensors.

Figure 4:
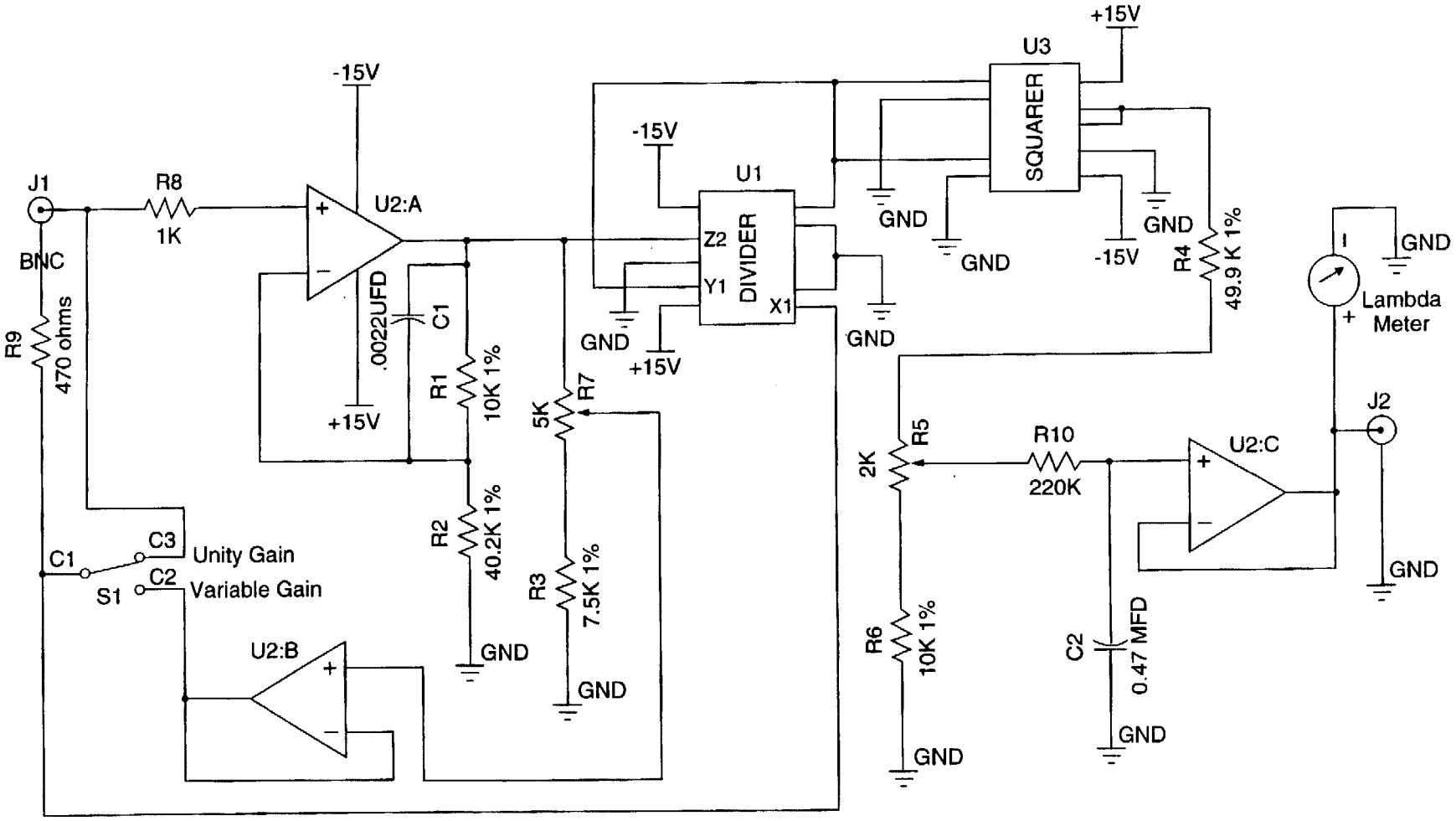
FIG. 4 is a circuit diagram of the apparatus of the present invention.

Turning now to FIG. 4, there is shown a circuit diagram of the apparatus 54 of the present invention. The input air flow signal from air flow sensor 42 is received at the inside connector of connector J1, while the outside connector carries the output signal for receipt by ECU 12. Instead of a connector, separate leads can be utilized to receive the input air flow signal and to transfer the output flow signal. The input flow signal is amplified by amplifier U2:A so as to effectively multiply the input flow signal by a constant, for example, 1.25. The constant must be at least large enough to ensure a sufficient range is available to effectively change lambda.

A fraction of the amplified signal is chosen by potentiometer R7 to obtain the new desired lambda within a predetermined range of desired gains. For example, a gain in the range of 0.75 to 1.25 may be desired in order to operate an internal combustion engine over as wide a range of air/fuel ratio as practical. Thus, potentiometer R7 must allow 60% –100% 'of the amplified signal to be selected in order to achieve a multiplier in the range of 0.75 to 1.25, i.e., the input air flow signal is multiplied by 1.25 and then the amplified signal is multiplied by 0.6 to 1.0. The resultant generates a factor for the input air flow signal in the range of 0.75 to 1.25. Alternatively, ECU 12 may be programmed to automatically adjust the gain based on predetermined engine conditions. The modified input flow signal is then buffered by amplifier U2:B and fed to ECU 12 instead of the original air flow signal.

Since ECU 12 is programmed to run the engine at lambda near one, ECU 12, believing the engine is running richer or leaner than it actually is, will adjust the fuel pulse width accordingly to maintain the predetermined lambda value. Thus, ECU 12 maintains the forced rich or lean engine operation accordingly until a new lambda is selected via apparatus 54 or the apparatus 54 is disabled.

In order to calibrate apparatus 54, apparatus 54 includes a switch S1 having a Unity Gain position C3 and a Variable Gain position C2. The Variable Gain position is selected when it is desirable to run the engine at different lambda values. The Unity Gain position is selected when it is desired to calibrate apparatus 54 or to run the engine under "normal" conditions. The input signal at X1 is divided by the modified air flow signal (or output signal) at Z2 via Divider U1.

The output Y1 of Divider U1 is then fed to Squarer U3 where the signal is squared. This value is reduced by the voltage divider consisting of resistors R4, R5 and R6, so that a value of 1 volt corresponds to a Lambda of 1 for display on a digital volt meter. Resistor R5 is a potentiometer which is adjusted until Lambda equals 1 when switch S1 is in the Unity Gain position. Amplifier U2:C provides the filtered Lambda signal to Lambda Meter and for external use through connector J2, if desired.

A computer ground connection to apparatus 54 is provided by a 12 VDC vehicle battery (not shown). The vehicle battery may also be used to power a conventional DC to DC converter (not shown) in apparatus 54 which provides ±15 volts power for the apparatus 54.

Figure 5:
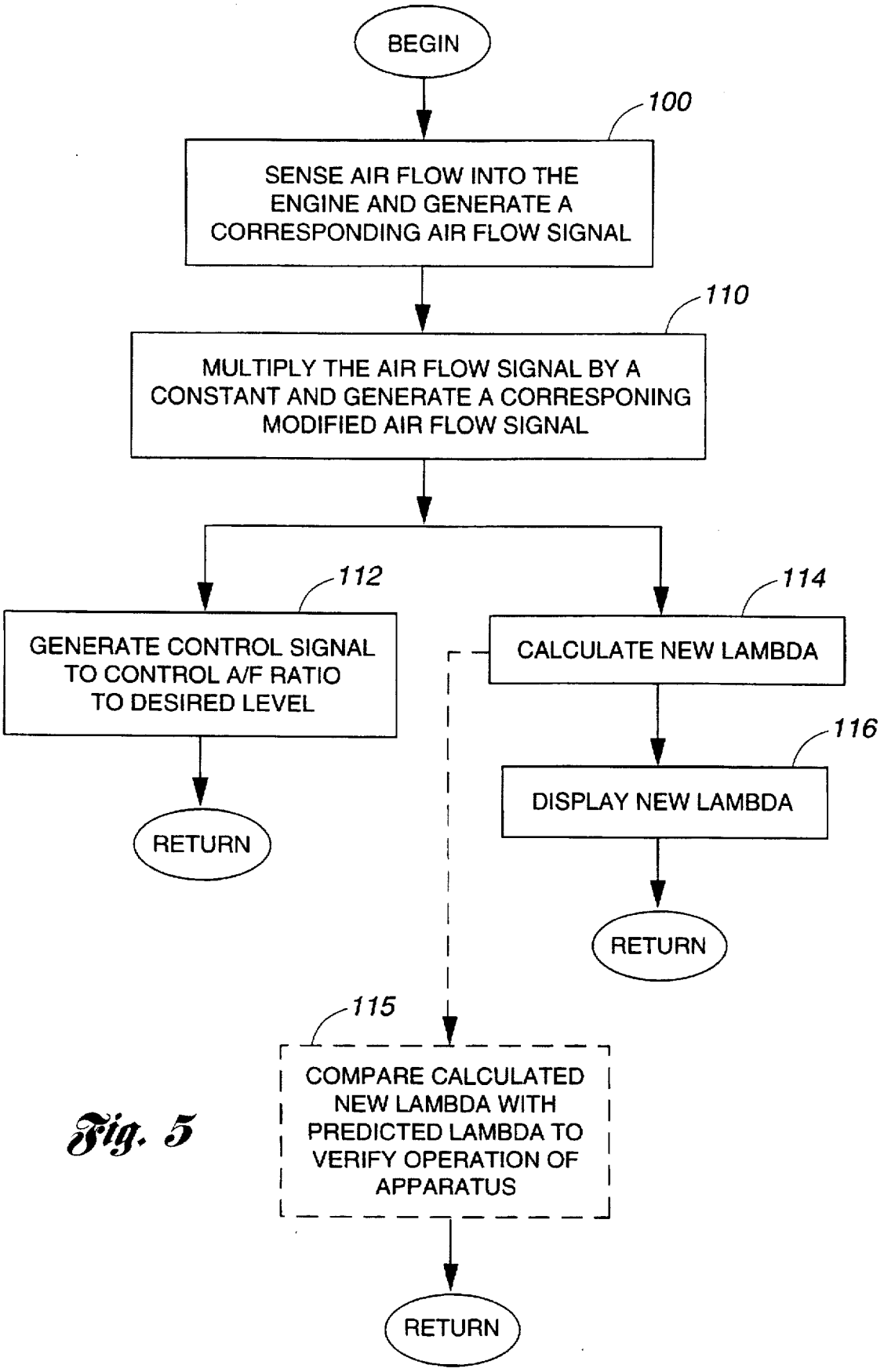
FIG. 5 is a flow diagram illustrating the general sequence of steps associated with the operation of the present invention.

Turning now to FIG. 5, there is shown a flow diagram illustrating the general sequence of steps associated with the method of the present invention. Although the steps shown in FIG. 5 are depicted sequentially, they can be implemented utilizing interrupt-driven programming strategies, object-oriented programming, or the like. In a preferred embodiment, the steps shown in FIG. 5 comprise a portion of a larger routine which performs other engine control functions.

The method begins with the step of sensing the air flow into the engine and generating a corresponding air flow signal, as shown at block 100. Next, the air flow signal is multiplied by a constant to generate a modified air flow signal corresponding to the desired level of richness or leanness, as shown at block 110.

A control signal is then generated by ECU 12 to control the air/fuel ratio to a desired level, as shown at block 112. ECU 12 then modifies the fuel pulse width accordingly so that the engine will be run predictably rich or lean.

Furthermore, a new lambda is calculated, as shown at block 114. As described above, new lambda is calculated by first dividing the input flow signal, i.e., air flow signal, by the output flow signal, i.e., modified air flow signal, and then squaring the result. The calculated new lambda can be compared to a predicted lambda value by ECU 12 for calibration purposes, as shown at block 115. Finally, the new lambda is displayed, as shown at block 116.

It is typically difficult to change the engine operating air/fuel ratio since it can only be changed by modifying the strategy coded in the ECU module. The present invention allows the engineer to investigate other air/fuel strategies without expensive on-board equipment, thus, saving testing time and development costs. The present invention also allows control of the air/fuel ratio for lean burn engines, diesel engines, or internal combustion engines where oxygen sensors cannot be used for air/fuel ratio control so as to minimize emissions.

While the best modes for carrying out the invention have been described in detail, those familiar with the art to which this invention relates will recognize various alternative designs and embodiments for practicing the invention as defined by the following claims.

What is claimed is:

1. A method for controlling air/fuel ratio of an internal combustion engine to a desired level of richness or leanness, wherein the engine normally includes a control logic connected thereto for normally controlling the air/fuel ratio at stoichiometry, the method comprising:

sensing air flow into the engine and generating a corresponding air flow signal;

multiplying the air flow signal by a constant corresponding to the desired level of richness or leanness to generate a modified air flow signal;

determining a desired amount of fuel based on the air flow signal and the modified air flow signal; and controlling the fuel to be delivered to the engine based on the desired amount of fuel to obtain the desired level of richness or leanness.

2. The method as recited in claim 1 wherein determining the amount of fuel includes determining a modified air/fuel ratio based on the air flow signal and the modified air flow signal.

3. The method as recited in claim 2 further comprising comparing the modified air/fuel ratio with a predicted air/fuel ratio to determine a difference.

4. The method as recited in claim 2 further comprising displaying the modified air/fuel ratio.

5. The method as recited in claim 1 wherein multiplying the air flow signal includes amplifying the air flow signal.

6. The method as recited in claim 5 wherein multiplying the air flow signal further includes selecting a fraction of the amplified air flow signal corresponding to the desired level of richness or leanness.

7. The method as recited in claim 2 wherein determining the modified air/fuel ratio comprises:

dividing the air flow signal by the modified air flow signal and generating a ratio signal; and squaring the ratio signal mathematically.

8. A system for controlling air/fuel ratio of an internal combustion engine to a desired level of richness or leanness, wherein the engine includes a control logic connected thereto for normally controlling the air/fuel ratio at stoichiometry, the system comprising:

an air flow sensor for sensing air flow into the engine and generating a corresponding air flow signal;

a signal multiplier in communication with the air flow sensor for multiplying the air flow signal by a constant corresponding to the desired level of richness or leanness to generate a modified air flow signal; and the control logic further operative to determine a desired amount of fuel based on the air flow signal and the modified air flow signal, and control the fuel to be delivered to the engine based on the desired amount of fuel to obtain the desired level of richness or leanness.

9. The system as recited in claim 8 further comprising a lambda calculator device for calculating a modified air/fuel ratio based on the air flow signal and the modified air flow signal.

10. The system as recited in claim 9 wherein the control logic is further operative to compare the modified air/fuel ratio with a predicted air/fuel ratio to determine a difference.

11. The system as recited in claim 9 further comprising a display for displaying the modified air/fuel ratio.

12. The system as recited in claim 8 wherein the signal multiplier comprises an amplifier for amplifying the air flow signal.

13. The system as recited in claim 12 wherein the signal multiplier further comprises a variable resistor connected to an output of the amplifier for selecting a fraction of the amplified air flow signal corresponding to the desired level of richness or leanness.

14. The system as recited in claim 9 wherein the lambda calculator device comprises:

a divider circuit for dividing the air flow signal by the modified air flow signal and generating a ratio signal; and a squarer circuit connected to the divider circuit for squaring the ratio signal mathematically.

15. A system for controlling air/fuel ratio of an internal combustion engine to a desired level of richness or leanness, wherein the engine includes a control logic connected thereto for normally controlling the air/fuel ratio of stoichiometry, the system comprising:

an air flow sensor for sensing air flow into the engine and generating a corresponding air flow signal;

means for multiplying the air flow signal by a constant corresponding to the desired level of richness or leanness to generate a modified air flow signal;

means for determining a desired amount of fuel based on the air flow signal and the modified air flow signal; and means for controlling the fuel to be delivered to the engine based on the desired amount of fuel to obtain the desired level of richness or leanness.

16. The system as recited in claim 15 further comprising means for calculating a modified air/fuel ratio based on the air flow signal and the modified air flow signal.

17. The system as recited in claim 16 further comprising means for comparing the modified air/fuel ratio with a predicted air/fuel ratio to determine a difference.

18. The system as recited in claim 15 wherein the means for multiplying comprises means for amplifying the air flow signal.

19. The system as recited in claim 18 wherein the means for multiplying further comprises means for selecting a fraction of the amplified air flow signal corresponding to the desired level of richness or leanness.

20. The system as recited in claim 16 wherein the means for calculating comprises:

means for dividing the air flow signal by the modified air flow signal and generating a ratio signal; and means for squaring the ratio signal mathematically.

* * * * *